US006260367B1

(12) United States Patent
Furuya et al.

(10) Patent No.: US 6,260,367 B1
(45) Date of Patent: Jul. 17, 2001

(54) REFRIGERATING CYCLE

(75) Inventors: Shunichi Furuya, Higashimatsuyama; Hiroshi Kanai, Konan, both of (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/529,876

(22) PCT Filed: Dec. 16, 1998

(86) PCT No.: PCT/JP98/05678

§ 371 Date: Apr. 21, 2000

§ 102(e) Date: Apr. 21, 2000

(87) PCT Pub. No.: WO99/34156

PCT Pub. Date: Jul. 8, 1999

(30) Foreign Application Priority Data

Dec. 26, 1997 (JP) ..... 9-369474

(51) Int. Cl.[7] ..... F25B 4/100
(52) U.S. Cl. ..... 62/197
(58) Field of Search ..... 62/197, 196, 190, 62/132, 117, 174, 513, 113, 114; 236/1; 123/41.09; 165/280, 283, 297

(56) References Cited

U.S. PATENT DOCUMENTS

| | | | | |
|---|---|---|---|---|
| 3,472,040 | * | 10/1969 | Taylor | 165/283 |
| 3,787,023 | * | 1/1974 | Shufflebarger et al. | 251/335.3 |
| 4,084,405 | * | 4/1978 | Schibbye et al. | 62/197 |
| 4,205,532 | * | 6/1980 | Brenan | 62/115 |
| 4,422,370 | * | 12/1983 | Gustavson | 454/51 |
| 4,446,778 | * | 5/1984 | Cipelletti | 99/455 |
| 4,476,674 | * | 10/1984 | Berman | 60/39.182 |
| 4,482,008 | * | 11/1984 | Nomaguchi et al. | 165/240 |
| 4,760,707 | * | 8/1988 | Dennis et al. | 62/197 |
| 4,844,202 | * | 7/1989 | Maresko | 184/6.12 |
| 5,056,329 | * | 10/1991 | Wilkinson | 62/197 |
| 5,242,011 | * | 9/1993 | Hesse | 165/283 |
| 5,357,766 | * | 10/1994 | Shiraishi et al. | 62/197 |
| 5,375,426 | * | 12/1994 | Burgener | 62/85 |
| 5,983,652 | * | 11/1999 | Iritani et al. | 62/156 |
| 6,029,449 | * | 2/2000 | Heikrodt et al. | 60/525 |
| 6,105,386 | * | 8/2000 | Kuroda et al. | 62/513 |

FOREIGN PATENT DOCUMENTS

| | | |
|---|---|---|
| 8-110104 | 4/1996 | (JP) . |
| 9-49662 | 2/1997 | (JP) . |

* cited by examiner

*Primary Examiner*—Teresa Walberg
*Assistant Examiner*—Daniel Robinson
(74) *Attorney, Agent, or Firm*—Wenderoth, Lind & Ponack, L.L.P.

(57) ABSTRACT

In a freezing cycle that utilizes a supercritical fluid as its coolant and employs an internal heat exchanger that performs heat exchange on the coolant on the outlet side of a gas cooler and on the intake side of a compressor, a means for adjustment that adjusts the quantity of heat exchange performed by the internal heat exchanger (4) is provided. The means for adjustment is constituted of a bypass passage (9) that bypasses the internal heat exchanger (4) and a flow-regulating valve (10) that adjusts the coolant flow rate in the bypass passage (9). The flow-regulating valve (10) is constituted of an electromagnetic valve, the degree of openness of which is determined based upon information with respect to the cycle state, or a bellows regulating valve that operates in correspondence to the pressure on the high-pressure side. Alternatively, the means for adjustment may perform adjustment by varying the passage length over which heat exchange is performed by the internal heat exchanger (4). Good cycle efficiency is achieved by maintaining the optimal high-pressure through cycle balance control. The freezing cycle can be temporarily protected against excessively high-pressure or excessively high discharge temperature at the compressor.

14 Claims, 4 Drawing Sheets

REFRIGERATING CYCLE

TECHNICAL FIELD

The present invention relates to a freezing cycle achieved by using a supercritical fluid as a coolant, and more specifically, it relates to a freezing cycle provided with an internal heat exchanger that performs further heat exchange on the coolant at the intake side of a compressor and again at the outlet side of a gas cooler that cools down the coolant that is at high-pressure, having been raised in pressure by the compressor.

BACKGROUND TECHNOLOGY

A great deal of interest is focused on a freezing cycle that uses carbon dioxide ($CO_2$) as one of the non-freon freezing cycles proposed as alternatives to a freezing cycle (freon cycle) that utilizes freon. While a freon cycle in the prior art requires a liquid reservoir such as a liquid tank to be provided in the high-pressure line in order to absorb fluctuations of the load and leaking of the coolant gas occurring over time, a $CO_2$ cycle, in which the temperature on the high-pressure side exceeds the critical point (31.1° C.), unlike in the freon cycle, does not allow a liquid tank to be provided in the high-pressure line, thus necessitating an accumulator to be provided on the downstream side relative to the evaporator.

As a result, since the liquid reservoir is provided on the downstream side relative to the evaporator, superheat control such as that adopted in a freon cycle cannot be implemented, and instead, a system that is capable of controlling the high-pressure must be provided.

In addition, since the freezing capability and the COP (coefficient of performance: freezing effect/compressor work) of a $CO_2$ cycle are inferior to those achieved by a freon cycle, the cycle structure as illustrated in Japanese Examined Patent Publication No. H 7-18602 may be adopted to improve the freezing capability and the COP.

To explain this cycle structure in reference to FIG. 5, a freezing cycle 1 that utilizes $CO_2$ is provided with a compressor 2 that raises the pressure of a coolant, a radiator 3 that cools down the coolant, an internal heat exchanger 4 that performs heat exchange for coolant flowing through a high-pressure line and a low-pressure line, an expansion valve 5 that reduces the pressure of the coolant, an evaporator 6 that evaporates and gasifies the coolant and an accumulator 7 that achieves gas/liquid separation for the coolant flowing out of the evaporator. In this cycle, the coolant in a supercritical state with its pressure having been raised at the compressor 2 is cooled down by the radiator 3 and is further cooled by the internal heat exchanger 4 before it enters the expansion valve 5. The pressure of the coolant thus cooled is reduced at the expansion valve 5 and thus the coolant becomes moist steam. After the coolant is evaporated at the evaporator 6, gas/liquid separation is achieved by the accumulator 7, and then heat exchange with the high-pressure side coolant is performed by the internal heat exchanger 4 so that the coolant becomes heated before it is returned to the compressor 2.

These changes in the state of the cycle are as indicated as A→B→C→D→E →F→A in the Mollier diagram in FIG. 6, with the coolant indicated by point A becoming compressed at the compressor 2 to become high-temperature, high-pressure coolant in the supercritical state indicated by point B, the high-temperature, high-pressure coolant cooled down to point C by the radiator 3 and further cooled down to point D by the internal heat exchanger 4. Then its pressure is reduced at the expansion valve 5 and the coolant becomes moist steam at a low temperature and a low pressure, as indicated by point E. Next, it becomes evaporated and gasified at the evaporator 6 before reaching point F. The coolant having passed through the evaporator 6 is further heated by the internal heat exchanger 4 up to point A, and then is compressed again by the compressor 2.

Thus, the cycle provided with the internal heat exchanger 4 achieves a freezing effect which is greater by the enthalpy difference between point E and point E' compared to the freezing effect achieved by a cycle without the internal heat exchanger 4 (F-B'-C-E'-F), and since the work performed by the compressor (the enthalpy difference between point A and point G) does not fluctuate greatly whether or not the internal heat exchanger 4 is provided, the COP can be increased by providing the internal heat exchanger 4.

It is known that the freezing capability and the COP of a $CO_2$ cycle are affected by high-pressure and that the COP is at its best at a certain pressure level (10~15 MPa). For instance, in the summer when the temperature of the coolant at the outlet of the gas cooler reaches approximately 40° C., there is a high-pressure β which allows the COP to reach a maximum value a as shown in FIG. 7.

In addition, while the presence of the internal heat exchanger 4 contributes to improving the COP as described above, it is known that there is an optimal value for the heat exchange quantity that allows the COP to reach its maximum value as shown in FIG. 8.

Accordingly, an object of the present invention is to provide a freezing cycle utilizing a supercritical fluid as a coolant and provided with an internal heat exchanger to perform heat exchange on the coolant at the outlet side of a gas cooler and at the intake side of a compressor, which is capable of achieving good cycle efficiency by maintaining an optimal high-pressure through cycle balance control. Another object of the present invention is to provide a freezing cycle which can be temporarily protected against excessively high-pressure or excessively high discharge temperature at the compressor.

DISCLOSURE OF THE INVENTION

In order to achieve the objects described above, the freezing cycle according to the present invention, which uses a supercritical fluid as a coolant comprises a compressor that raises the pressure of the coolant, a gas cooler that cools down the coolant whose pressure has been raised at the compressor, an internal heat exchanger that performs heat exchange on the coolant at the outlet side of the gas cooler and at the intake side of the compressor, a means for pressure reduction that reduces the pressure of the coolant supplied from the gas cooler via the internal heat exchanger and an evaporator that evaporates the coolant whose pressure has been reduced by the means for pressure reduction. It adopts a cycle structure in which the coolant flowing out of the evaporator is returned to the compressor via the internal heat exchanger, and is characterized in that it is provided with a means for adjustment that adjusts the quantity of heat exchange performed at the internal heat exchanger.

Thus, the high-temperature, high-pressure coolant having entered a supercritical state with its pressure raised at the compressor is then cooled by the gas cooler and is further cooled by the internal heat exchanger before it is led to the means for pressure reduction where its pressure is reduced until it becomes low-temperature, low-pressure moist steam. After it is evaporated and gasified at the evaporator, it enters the internal heat exchanger where its heat is exchanged with the heat of the high-pressure side coolant, and then it is supplied to the compressor so that its pressure can be raised again. In this type of cycle, in which the high-pressure line operates in the supercritical range, if the high-pressure is caused to fluctuate by the external air temperature or the cooling load, the freezing effect will correspondingly fluctuate. However, by adjusting the quantity of heat exchange performed by the internal heat exchanger with the means for adjustment, the high-pressure is maintained at an optimal level, thereby making it possible to achieve the maximum cycle efficiency.

While a fluid such as $CO_2$ with a critical temperature in the vicinity of room temperature is used as the supercritical fluid and the cycle structure is provided with, at least, a compressor, a gas cooler, an internal heat exchanger, a means for pressure reduction and an evaporator as minimum requirements, the structure may be further provided with an accumulator on the coolant downstream side relative to the evaporator or an oil separator between the compressor and the gas cooler.

An effective structure that may be adopted in the means for adjustment is constituted of a bypass passage that bypasses the internal heat exchanger and a flow-regulating valve that adjusts the coolant flow rate in the bypass passage. The flow-regulating valve provided at the bypass passage may be constituted of an electromagnetic valve, the degree of openness of which is determined based upon information regarding the cycle state, or a bellows regulating valve that operates in correspondence to the pressure in the high-pressure line. While the bypass passage may be provided in the high-pressure line, it is more desirable to provide it in the low-pressure line from the freezing cycle design aspect.

With the means for adjustment structured as described above, the flow rate of the coolant flowing through the internal heat exchanger is adjusted by controlling the flow rate of the coolant flowing through the bypass passage and, as a result, the high-pressure can be set to an optimal level by varying the quantity of heat exchange performed by the internal heat exchanger.

Instead of adjusting the flow rate in the bypass passage, the means for adjustment may perform adjustment by varying the length of the passage over which heat exchange is performed by the internal heat exchanger. With the means for adjustment structured as described above, the quantity of heat exchange performed by the internal heat exchanger is adjusted and likewise, the cycle balance is controlled, by varying the range over which heat exchange is achieved between the high-pressure side coolant and the low pressure side coolant even when the flow rate of the coolant flowing into the internal heat exchanger remains constant.

THE BEST MODES FOR CARRYING OUT INVENTION

The following is an explanation of preferred embodiments of the present invention given in reference to the drawings.

Figure 1:
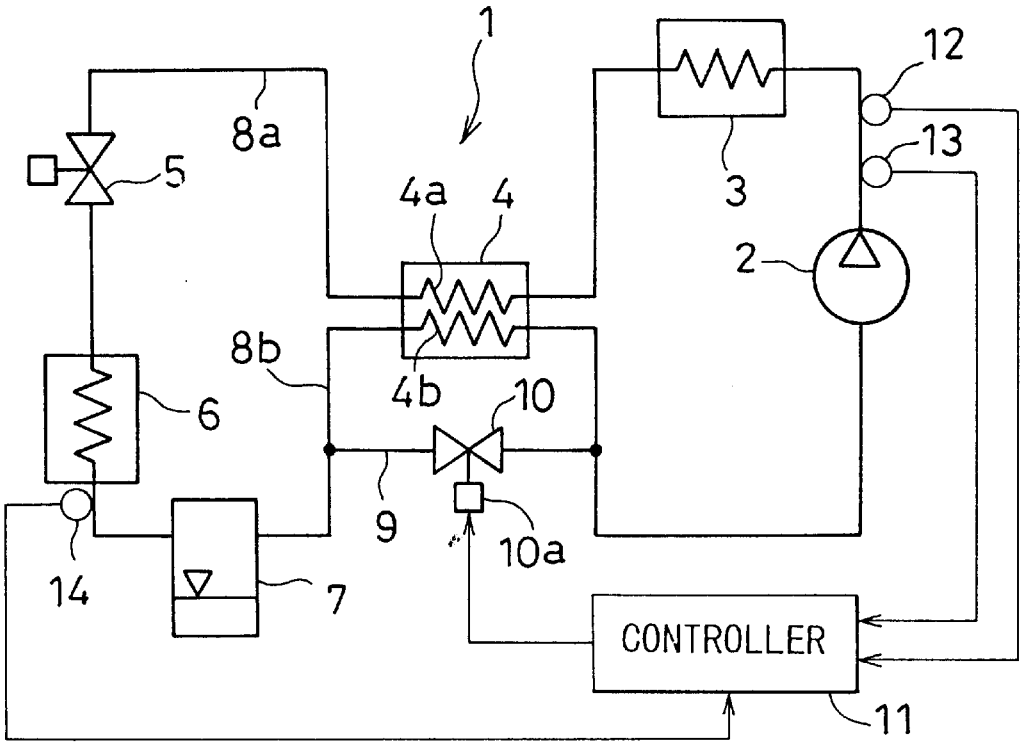
FIG. 1 illustrates a structural example of a freezing cycle according to the present invention.

In FIG. 1, a freezing cycle 1 comprises a compressor 2 that compresses a coolant, a gas cooler 3 that cools down the coolant, an internal heat exchanger 4 that performs heat exchange on the coolant in the high-pressure line and the coolant in the low-pressure line, an expansion valve 5 that reduces the pressure of the coolant, an evaporator 6 that evaporates and gasifies the coolant and an accumulator 7 that achieves gas-liquid separation of the coolant.

In this freezing cycle 1, a passage extending from the compressor 2 to the inflow side of the expansion valve 5, achieved by connecting the discharge side of the compressor 2 to a high-pressure passage 4*a* of the internal heat exchanger 4 via the gas cooler 3 and connecting the outflow side of the high-pressure passage 4*a* to the expansion valve 5, constitutes a high-pressure line 8*a*. In addition, the outflow side of the expansion valve 5 is connected to the evaporator 6 and the outflow side of the evaporator 6 is connected to a low pressure side passage 4*b* of the internal heat exchanger 4 via the accumulator 7. A passage extending from the outflow side of the expansion valve 5 to the compressor 2 achieved by connecting the outflow side of the low pressure passage 4*b* to the intake side of the compressor 2 constitutes a low-pressure line 8*b*.

In this freezing cycle 1, $CO_2$ is utilized as the coolant, and the coolant compressed by the compressor 2 enters the radiator 3 as a high-temperature, high-pressure coolant in a supercritical state, to radiate heat and become cooled. Then, it is further cooled down through heat exchange with the low temperature coolant in the low-pressure line 8*b* at the internal heat exchanger 4, and is supplied to the expansion valve 5 without becoming liquefied. Next, its pressure is reduced at the expansion valve 5 until it becomes low-temperature, low-pressure moist steam, and then becomes evaporated and gasified at the evaporator 6 through heat exchange with the air passing through the evaporator 6. Subsequently, the coolant undergoes gas-liquid separation at the accumulator 7 and the gas-phase coolant alone is guided to the internal heat exchanger 4 where it undergoes heat exchange with the high-temperature coolant in the high-pressure line 8*a* before it is returned to the compressor 2.

In addition, a bypass passage 9 which bypasses the internal heat exchanger 4 is provided in the low-pressure line 8*b* in the freezing cycle 1. Namely, one end of the bypass passage 9 is connected between the accumulator 7 and the internal heat exchanger 4 and the other end is connected between the internal heat exchanger 4 and the compressor 2 so that the gas-phase coolant resulting from the separation achieved at the accumulator 7 is directly delivered to the compressor 2.

Furthermore, a flow-regulating valve 10 that adjusts the flow rate of the coolant flowing through the bypass passage 9 is provided at the bypass passage 9. The flow-regulating valve 10 may be constituted of, for instance, an electromagnetic valve, the degree of openness of which is varied by a stepping motor 10*a*, and its degree of openness is automatically controlled by a controller 11.

The controller 11, which comprises a central processing unit (CPU), a read only memory (ROM), a random access memory (RAM), an input/output port (I/O) and the like (not shown), is provided with a drive circuit for driving the stepping motor 10*a* of the flow-regulating valve 10 and processes various signals related to the cycle state in conformance to a specific program provided in the ROM.

Figure 2:
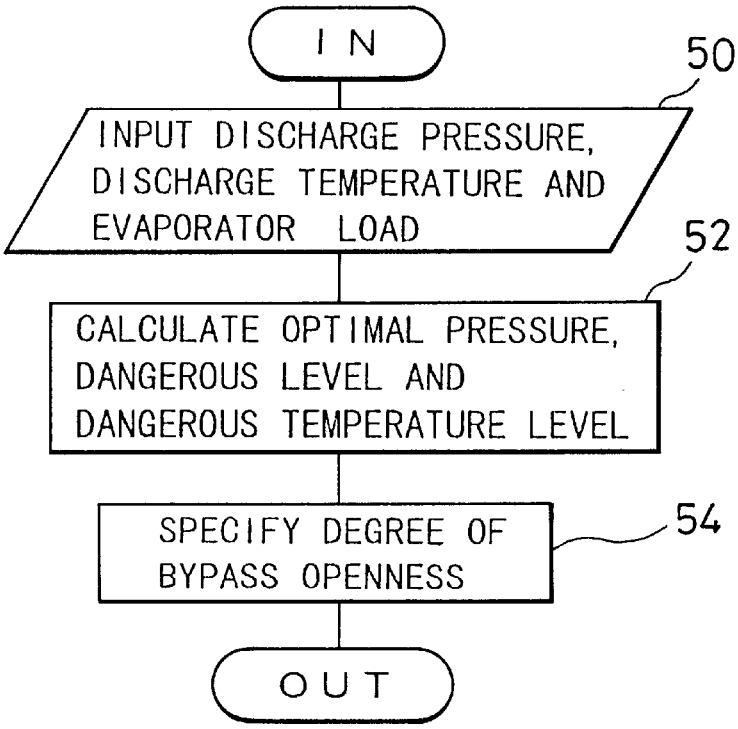
FIG. 2 is a schematic flowchart of an electromagnetic control implemented by a controller in FIG. 1.

In other words, the controller 11 engages in the processing illustrated in FIG. 2, in which a pressure signal from a pressure sensor 12 that detects the discharge pressure at the compressor 2, a signal from a discharge temperature sensor 13 that detects the discharge temperature at the compressor 2 and a signal from an evaporator temperature sensor 14 that detects the load applied to the evaporator 6 as, for instance, the coolant temperature at the outlet of the evaporator are input (step 50), an optimal pressure that allows the COP to reach the maximum value is calculated based upon the signals, a decision is made as to whether or not the high-pressure has risen to a level in the danger zone and a decision is made as to whether or not the discharge temperature has risen to a dangerous level (step 52) and the degree of openness of the electromagnetic valve is determined based upon the results obtained in step 52 to implement drive control on the degree of openness of the flow-regulating valve 10 so that the desired degree of openness is achieved (step 54).

Figure 7:
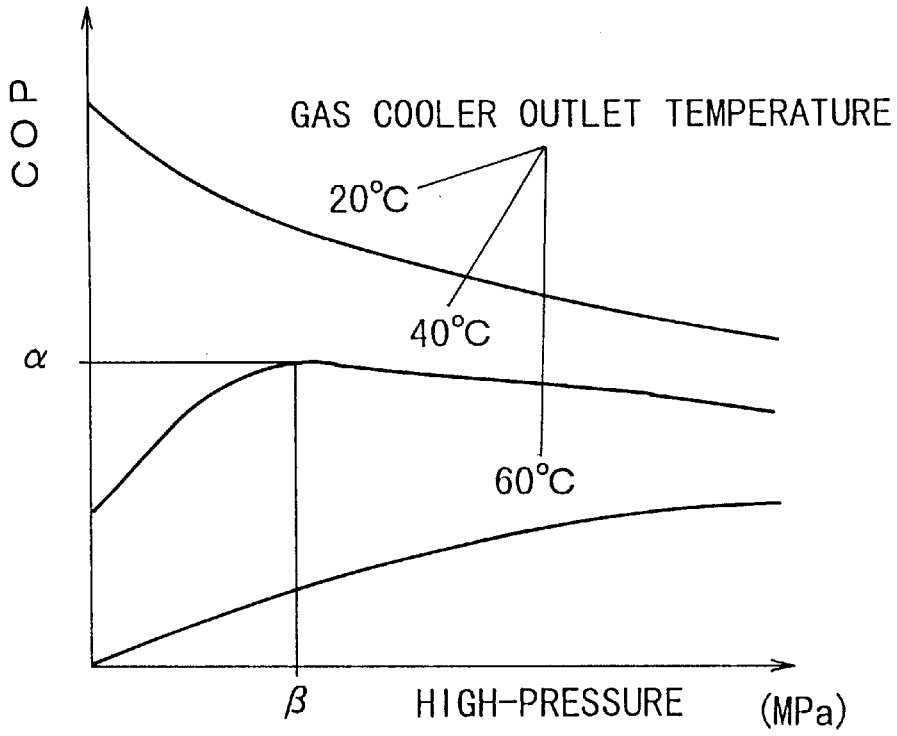
FIG. 7 is a characteristics diagram illustrating the relationship between the high-pressure in the freezing cycle provided with an internal heat exchanger shown in FIG. 5 and its COP.
Figure 8:
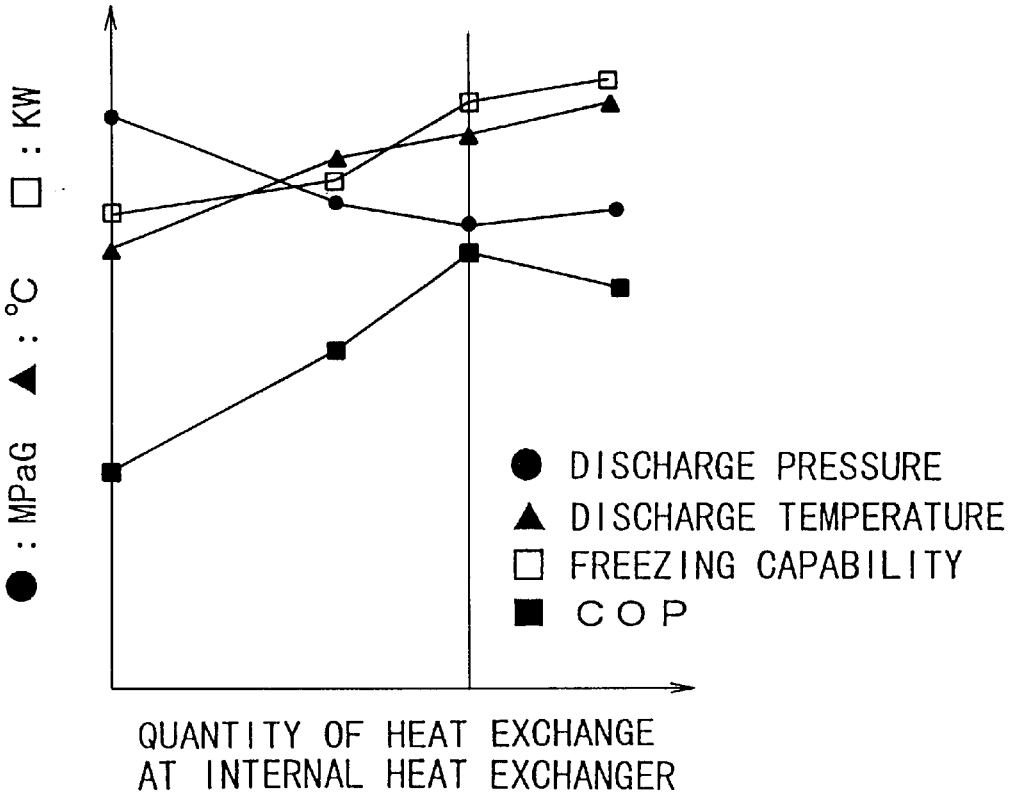
FIG. 8 is a characteristics diagram illustrating the relationships among the quantity of heat exchange performed by the internal heat exchanger shown in FIG. 5, the discharge pressure of a compressor, the discharge temperature at the compressor, the freezing capability of the cycle and the COP.

In the structure described above, if it is necessary to achieve the maximum COP, for instance, a decision can be made with respect to the quantity of heat exchange to be set for the internal heat exchanger 4 to achieve the optimal discharge pressure that allows the COP to reach the maximum value as indicated through the relationships in FIGS. 7 and 8, and thus, the degree of openness of the flow-regulating valve 10 is controlled to achieve this heat exchange quantity.

Furthermore, in addition to maintaining the most desirable operating state, the cycle can be temporarily protected by adjusting the coolant flow rate in the bypass passage 9 with the flow-regulating valve 10 if the pressure on the high-pressure side has risen to a level in the danger zone due to a fluctuation of the load or if the discharge temperature has risen to an excessive degree.

In more specific terms, if the high-pressure detected by the pressure sensor 12 has risen to a level in the danger zone due to a fluctuation of the load or the like, the flow-regulating valve 10 is closed to stop the coolant from flowing into the bypass passage 9 so that the quantity of heat exchange performed by the internal heat exchanger 4 is increased. As indicated by the characteristics presented in FIG. 8, by increasing the quantity of heat exchange performed by the internal heat exchanger, the discharge pressure (indicated by the ●) can be lowered.

In addition, if the discharge temperature detected by the discharge temperature sensor 13 has risen to a level in the danger zone due to a fluctuation of the load or the like, the degree of openness of the flow-regulating valve 10 is increased to increase the flow rate of the coolant flowing into the bypass passage 9 so that the quantity of heat exchange performed by the internal heat exchanger 4 is reduced. As indicated by the characteristics presented in FIG. 8, by reducing the quantity of heat exchange performed by the internal heat exchanger 4, the discharge temperature (indicated by the ▲) is lowered.

By changing the quantity of heat exchange performed by the internal heat exchanger 4 with the flow-regulating valve 10, the cycle balance can be controlled freely to maintain the optimal high pressure so that the maximum cycle efficiency is achieved and also to temporarily protect the cycle if the pressure on the high-pressure side or the discharge temperature has risen to an excessive degree. As a result, control, which is implemented in correspondence to the heat load can be implemented in a freezing cycle that uses a supercritical fluid, as an alternative to the superheat control implemented in a freon cycle in the prior art.

Figure 3:
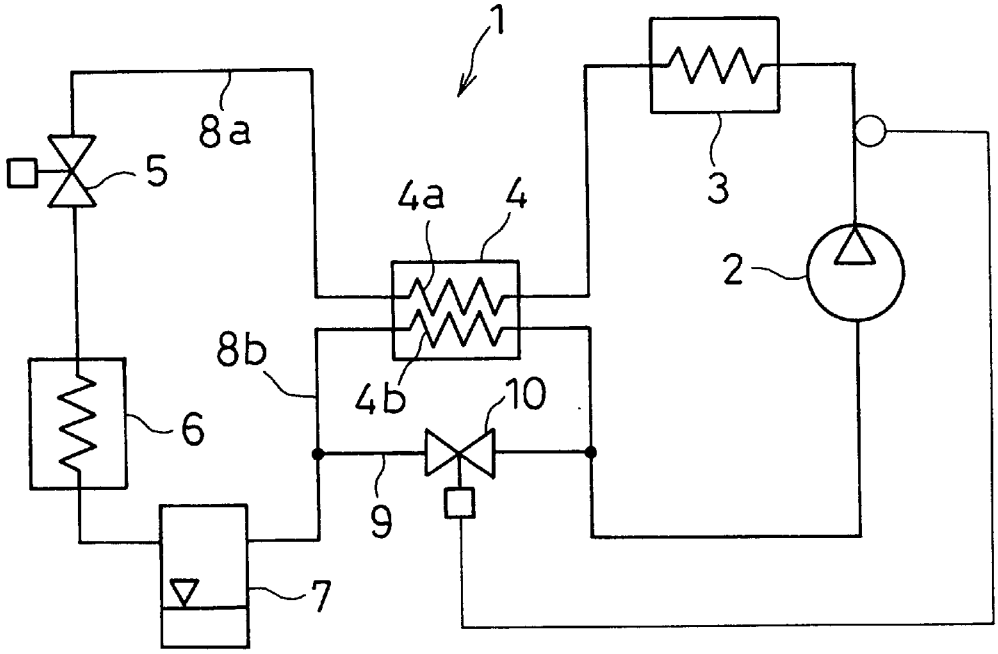
FIG. 3 illustrates another structural example that may be adopted to control a coolant flow rate in a bypass passage shown in FIG. 1.

FIG. 3 illustrates another structural example that may be adopted to implement control on the bypass flow rate. In this example, the flow-regulating valve 10 is constituted of, for instance, a bellows valve, the degree of openness of which is adjusted in correspondence to the discharge pressure at the compressor 2, and the degree of openness of the bypass passage is reduced as the high-pressure rises to increase the flow rate of the coolant flowing into the internal heat exchanger 4. By adopting this structure, since the pressure on the high-pressure side is fed back at all times to determine the coolant flow rate at the bypass passage 9, the quantity of heat exchange performed by the internal heat exchanger 4 can be adjusted to sustain the pressure on the high pressure side at the optimal level at all times and, likewise, to achieve the maximum cycle efficiency even when the cooling load or the like has fluctuated.

It is to be noted that while the bypass passage 9 shown in FIGS. 1 and 3 may instead be provided in the high-pressure line 8*a* so as to connect the outlet side of the gas cooler 3 and the intake side of the expansion valve 5, it is more desirable to provide it in the low-pressure line 8*b*, as illustrated in the figures, so as to connect the outlet side of the accumulator 7 and the intake side of the compressor 2.

This depends on reasons of ① if the bypass passage is provided in the high-pressure line 8*a*, a great quantity of high-density gas concentrates in the high-pressure line 8*a* to raise the pressure at the low-pressure line 8*b* greatly when the cycle operation stops, at which point the pressure over the entire cycle achieves equilibrium. If, on the other hand, the bypass passage is provided in the low-pressure line 8*b*, the coolant density within the bypass passage is lower, even while the volumetric capacity of the entire cycle remains the same, so that the equilibrium pressure at the time of cycle stop can be reduced; ② it is necessary to reduce the volumetric capacity of the cycle and, in particular, the volumetric capacity of the high-pressure side, in order to reduce the volumetric capacity of the accumulator 7 provided on the low pressure side; ③ while it is necessary to ensure that the flow-regulating system is capable of withstanding a high level of pressure within the range of 10~15 MPa to which the pressure on the high-pressure side rises when providing the bypass passage on the high-pressure side to adjust the flow rate, an existing device can be utilized if the bypass passage is provided in the low-pressure line 8*b*; and so on.

Figure 4:
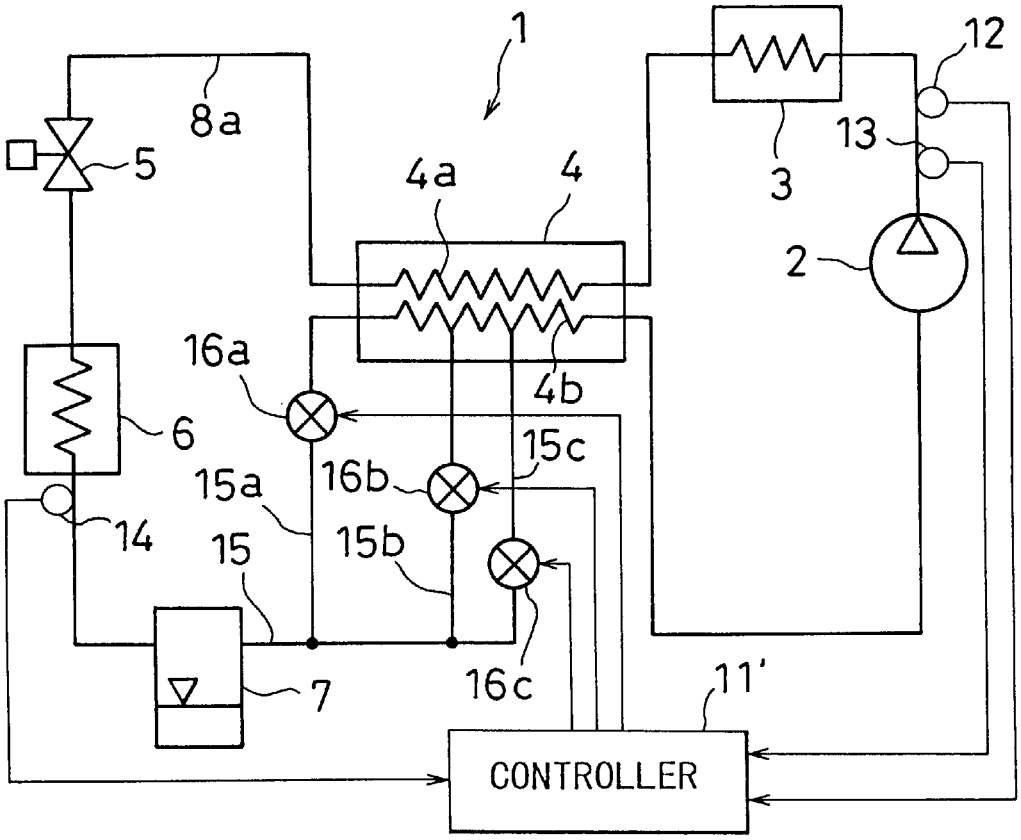
FIG. 4 illustrates yet another structural example that may be adopted to control the quantity of heat exchange performed by the internal heat exchanger shown in FIG. 1.
Figure 5:
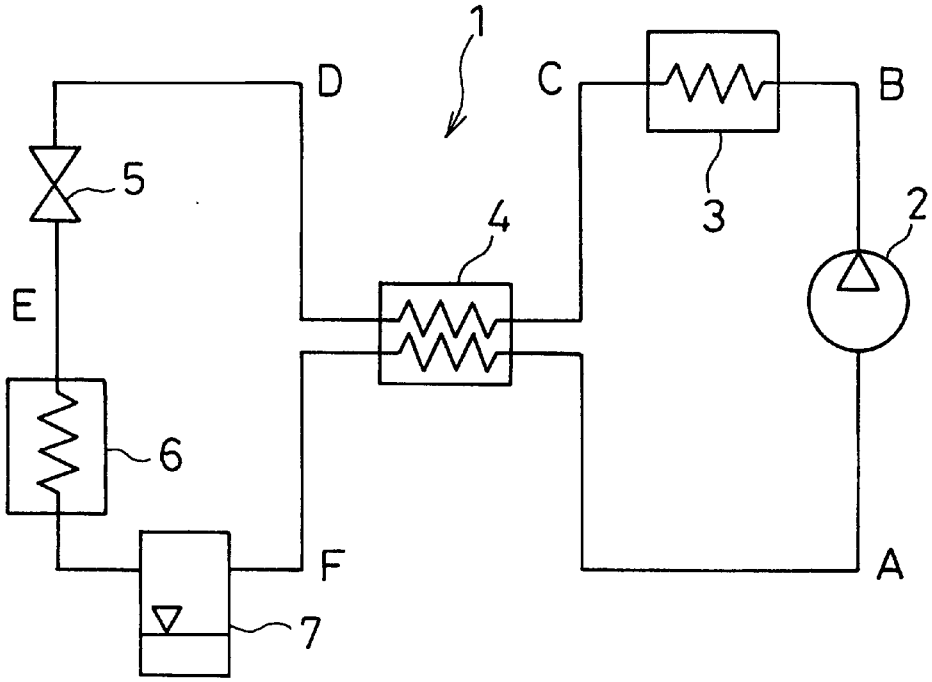
FIG. 5 illustrates the structure of a freezing cycle in the prior art.
Figure 6:
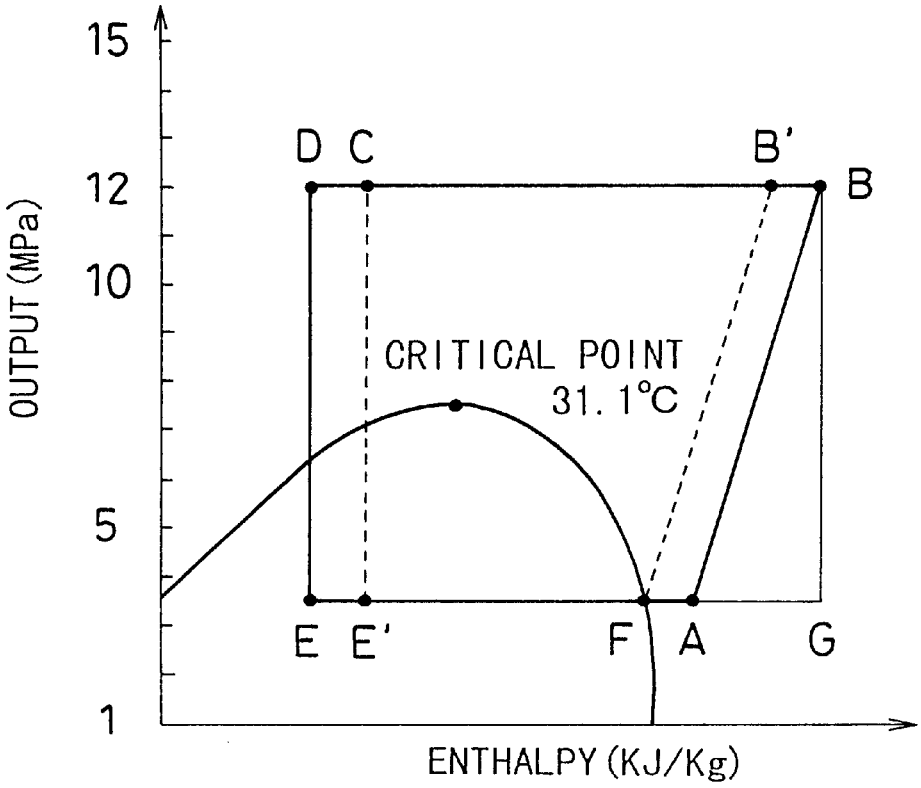
FIG. 6 presents a Mollier diagram of the freezing cycle shown in FIG. 5.

FIG. 4 illustrates another example of the means for adjustment provided to adjust the quantity of heat exchange performed by the internal heat exchanger 4, and the following explanation will mainly focus on differences from the previous example with the same reference numbers assigned to identical components to preclude the necessity for repeated explanation thereof.

In the freezing cycle 1, a passage 15 through which the coolant flows from the accumulator 7 into the internal heat exchanger 4 branches into a plurality of branch passages (e.g., 3 passages) 15*a,* 15*b* and 15*c*. The first branch passage 15*a* is connected so that the coolant is allowed to flow through the entire low pressure passage 4*b* of the internal heat exchanger 4, the second branch passage 15*b* is connected at a position at which the coolant flows into the low pressure passage 4*b* approximately ⅔ of the way along its length from the outflow end and the third branch passage 15*c* is connected at a position at which the coolant flows into the low pressure passage 4*b* approximately ⅓ of the way along its length from the outflow end. The individual branch passages are opened/closed by flow-regulating valves 16*a,* 16*b* and 16*c* respectively, each constituted of an electromagnetic valve. The flow-regulating valves 16*a,* 16*b* and 16*c* are driven/controlled by a controller 11'.

This controller 11', too, is capable of controlling the heat exchange quantity by receiving signals from the pressure sensor 12, which detects the discharge pressure at the compressor 2, discharge temperature sensor 13, which detects the discharge temperature at the compressor 2 and the evaporator temperature sensor 14, which detects the load applied to the evaporator 6 as, for instance, the coolant temperature at the outlet of the evaporator, determining whether the individual flow-regulating valves 16*a,* 16*b* and 16*c* are to be opened/closed in conformance to a specific program provided in advance and changing the range of heat exchange (the passage length over which heat exchange is achieved) performed by the internal heat exchanger 4.

If it is necessary to maximize the COP, for instance, control whereby the flow regulating valve corresponding to the branch passage that will maximize the COP is selected and opened in conformance to the relationships illustrated in FIGS. 7 and 8 and the other flow-regulating valves are closed, is implemented in the structure described above.

In addition, if the high-pressure detected by the pressure sensor 12 has risen to a level in the danger zone due to a fluctuation of the load or the like, the second and third flow-regulating valves 16*b* and 16*c* are closed and the first flow-regulating valve 16*a* is opened, to set the quantity of heat exchange performed by the internal heat exchanger 4 to the maximum level. As indicated by the characteristics presented in FIG. 8, by increasing the quantity of heat exchange performed by the internal heat exchanger 4, the discharge pressure can be lowered. Furthermore, if the discharge temperature detected by the discharge temperature sensor 13 has risen to a level in the danger zone due to a fluctuation of the load or the like, the first and second flow-regulating valves 16*a* and 16*b,* for instance, are closed and the third flow-regulating valve 16*c* is opened to reduce the quantity of heat exchange performed by the internal heat exchanger. As indicated by the characteristics presented in FIG. 8, by reducing the quantity of heat exchange performed by the internal heat exchanger 4, the discharge temperature can be lowered.

By adjusting the quantity of heat exchange performed by the internal heat exchanger 4 through the open/close control of the flow-regulating valves 16*a,* 16*b* and 16*c* in this manner, the cycle balance can be controlled and a high degree of cycle efficiency can be maintained. At the same time, if the pressure on the high pressure side or the discharge temperature rises to an excessive degree, it can be lowered so that the cycle is temporarily protected.

It is to be noted that while a plurality of branch passages are provided on the inflow side of the low pressure passage 4*b* of the internal heat exchanger 4 to vary the heat exchange range (the passage length over which heat exchange is achieved) for the internal heat exchanger 4 in the example described above, similar advantages may be achieved by branching the outflow side of the low pressure passage 4*b* into a plurality of passages to vary the length over which heat exchange is achieved or by providing a branch passage on the inflow side or the outflow side of the high-pressure passage 4*a* of the internal heat exchanger to vary the heat exchange range (the passage length over which heat exchange is achieved). In addition, the number of such branch passages should be determined by taking into consideration the required control accuracy and the practicality and may be set at 2, 4 or more.

Furthermore, any of structures that allow the coolant flow rate or the passage length over which heat exchange is performed, other than the structures described above provided with the bypass passage and the branch passages, may be adopted in the method of controlling the quantity of heat exchange performed by the internal heat exchanger.

Industrial Applicability

As explained above, according to the present invention, the freezing cycle utilizing a supercritical fluid as its coolant is provided with an internal heat exchanger that performs heat exchange on the coolant on the outlet side of the gas cooler and the coolant on the intake side of the compressor and a means for adjustment that adjusts the quantity of heat exchange performed by the internal heat exchanger and, as a result, the cycle balance can be controlled with ease by varying the quantity of heat exchange performed by the internal heat exchanger to control the high-pressure of the cycle, the discharge temperature at the compressor, the freezing capability of the cycle, the COP and the like.

Consequently, even when the cycle balance is shifted by the external air temperature or the internal load, the high-pressure in the freezing cycle can be maintained at the optimal level by adjusting the quantity of heat exchange performed by the internal heat exchanger to achieve the maximum cycle efficiency. Moreover, in addition to maintaining the optimal operating state, the cycle can be temporarily protected by suppressing the high-pressure or the discharge temperature at the compressor that has reached a level in the danger zone due to a fluctuation of the load or the like through adjustment of the quantity of heat exchange performed by the internal heat exchanger.

What is claimed is:

1. A freezing cycle utilizing a supercritical fluid as a coolant thereof, comprising: a compressor that raises the pressure of the coolant; a gas cooler that cools down the coolant whose pressure has been raised by said compressor; an internal heat exchanger that performs heat exchange for the coolant on an outlet side of said gas cooler and the coolant on an intake side of said compressor; a means for pressure reduction that reduces the pressure of the coolant supplied from said gas cooler via said internal heat exchanger; and an evaporator that evaporates the coolant, whose pressure has been reduced by said means for pressure reduction; wherein the coolant flowing out of said evaporator is made to be returned to said compressor via said internal heat exchanger, characterized in that a means for adjustment is provided that adjusts the quantity of heat exchange performed by said internal heat exchanger.

2. A freezing cycle according to claim 1, wherein:

said means for adjustment is constituted of a bypass passage that bypasses said internal heat exchanger and a flow-regulating valve that adjusts the flow rate of the coolant flowing through said bypass passage.

3. A freezing cycle according to claim 2, wherein:

said flow-regulating valve is constituted of an electromagnetic valve, the degree of openness of which is determined in conformance to information regarding the cycle state.

4. A freezing cycle according to claim 3, wherein:

the degree of openness of said electromagnetic valve is determined in conformance to said information with regard to the cycle state so as to achieve a discharge pressure at said compressor that results in a maximum coefficient of performance.

5. A freezing cycle according to claim 3, wherein:

the degree of openness of said electromagnetic valve is determined in conformance with information regarding the cycle state so that the quantity of heat exchange performed by said internal heat exchanger is increased by closing said electromagnetic valve when the pressure on the high-pressure side has risen to a level equal to or higher than a specific pressure.

6. A freezing cycle according to claim 3, wherein:

the degree of openness of said electronic valve is determined in conformance with information regarding the cycle state so that the quantity of heat exchange performed by said internal heat exchanger is reduced by increasing the degree of openness of said electromagnetic valve if the discharge temperature at said compressor rises to a level equal to or higher than a specific temperature.

7. A freezing cycle according to claim 2, wherein:

said flow-regulating valve is constituted of a bellows regulating valve, the degree of openness of which is adjusted in correspondence with the pressure in a high-pressure line in said cycle.

8. A freezing cycle according to claim 2, wherein:

said bypass passage connects a downstream side of said evaporator and an intake side of said compressor.

9. A freezing cycle according to claim 1, wherein:

said means for adjustment varies the passage length over which heat exchange is performed by said internal heat exchanger.

10. A freezing cycle according to claim 9, wherein:

a means for changing said passage length is achieved by providing a plurality of branch passages on an inflow side or an outflow side of said internal heat exchanger, connecting said branch passages at different positions along said passage length within said internal heat exchanger, providing flow-regulating valves individually in said branch passages and selecting a flow-regulating valve to be opened among said flow-regulating valves.

11. A freezing cycle according to claim 10, wherein:

a flow-regulating valve that allows the coefficient of performance to reach a maximum value is selected to be opened.

12. A freezing cycle according to claim 10, wherein:

a flow-regulating valve that increases said passage length when the pressure on the high-pressure side has risen to a level equal to or higher than a specific pressure is selected to be opened.

13. A freezing cycle according to claim 10, wherein:

a flow-regulating valve that reduces said passage length when the discharge temperature at said compressor has risen to a level equal to or higher than a specific temperature is selected to be opened.

14. A freezing cycle according to claim 1, 2 or 9, wherein:

the supercritical fluid is carbon dioxide.

* * * * *